United States Patent [19]

Kaltenbach et al.

[11] 4,095,540

[45] Jun. 20, 1978

[54] SEWING MACHINE STITCH REGULATING MECHANISMS

[75] Inventors: Kenneth Francis Kaltenbach, Leonia; Alfred John Zenger, Montville, both of N.J.

[73] Assignee: The Singer Company, New York, N.Y.

[21] Appl. No.: 773,106

[22] Filed: Feb. 28, 1977

[51] Int. Cl.[2] ..... D05B 27/00

[52] U.S. Cl. ..... 112/210

[58] Field of Search ..... 112/210, 209, 206, 203, 112/47, 211

[56] References Cited

U.S. PATENT DOCUMENTS

| | | | |
|---|---|---|---|
| 2,119,492 | 5/1938 | Sauer et al. | 112/210 |
| 2,414,652 | 1/1947 | Liniger | 112/210 |
| 2,685,266 | 8/1954 | Pagni | 112/210 |
| 2,818,039 | 12/1957 | Ayres | 112/210 |
| 2,846,966 | 8/1958 | Engel | 112/210 |
| 3,036,535 | 5/1962 | Dunn et al. | 112/210 |
| 3,202,121 | 8/1965 | Orth et al. | 112/209 |
| 3,368,507 | 2/1968 | Orth | 112/209 |
| 3,467,040 | 9/1969 | Hacklander | 112/210 |
| 3,834,334 | 9/1974 | Adams et al. | 112/210 |
| 3,949,691 | 4/1976 | Adams | 112/210 |

*Primary Examiner*—Werner H. Schroeder
*Assistant Examiner*—Moshe I. Cohen
*Attorney, Agent, or Firm*—Robert E. Smith; Edward L. Bell; Alan Ruderman

[57] ABSTRACT

A feed system for an industrial sewing machine having a toggle type stitch regulator. The feet stop for determining forward stitch length is located in the sewing machine frame for direct engagement with the stitch length regulating yoke to reduce vibration and noise in the system. The feed length is adjusted by a knob through a gear train connected through the bed of the machine to the stop abutment so as to allow stitch length adjustment without tipping the sewing machine. An elastomeric dynamic damper is included in the regulating system so that during reverse feed when the regulating yoke is displaced from the stop abutment the damper is effective to reduce vibration and noise that would normally travel through the system to the reversing lever.

2 Claims, 4 Drawing Figures

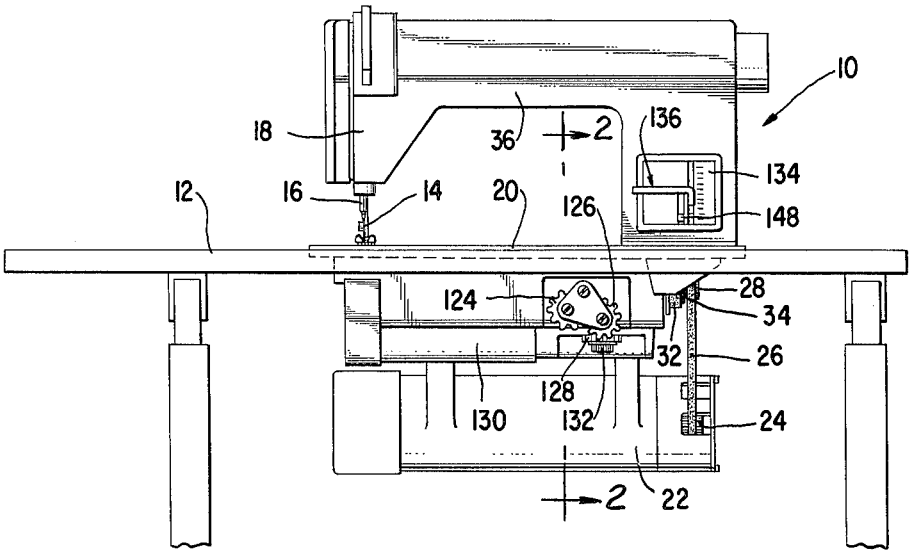
Fig. 1
Fig. 2
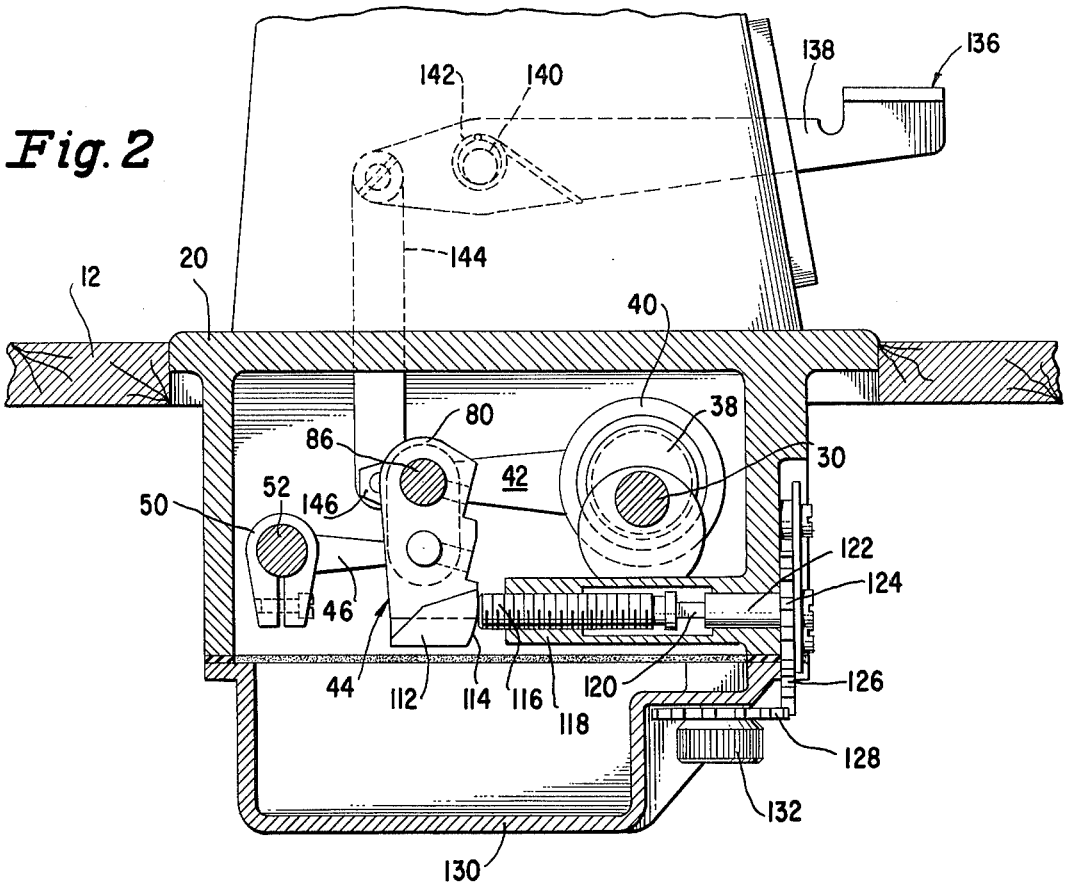

SEWING MACHINE STITCH REGULATING MECHANISMS

BACKGROUND OF THE INVENTION

This invention relates to sewing machines and more particularyly to an accessible vibration dampening stitch length regulator adapted for high speed sewing machines.

The control of stitch length for a high speed industrial sewing machine creates problems not known to lower speed machines. Industrial machines often have stitch length regulator mechanisms incorporating a toggle link beneath the bed in the feed drive connection. Generally the feed stop determining forward stitch length and the regulator lever which it abuts in these machines have been located in the standard upstanding from the bed so as to be conveniently located for manipulation by the operator. It has been found, however, that this location for the stop is so remote from the regulating toggle in the bed that excessively dangerous vibrations were occasioned during high speed operation.

A solution to this problem is to locate the stop abutment in the frame beneath the bed in close proximity to the stitch regulating toggle. In this manner the dynamic loads generated in the toggle mechanism can be transmitted to the stop in a short, stiff and direct path and absorbed by the frame. In the previously known sewing machines utilizing this type of stitch regulator mechanism the operator did not have access to the regulator member without being required to tip the machine back from its rest position or by inserting a screw driver into the bed. One machine exemplifying this arrangement is illustrated in Washburn, U.S. Pat. No. 3,357,384.

Moreover, when it is desirable to reverse stitch at the end of a seam, for example, the operator depresses the reverse feed lever. The reverse feeding lever is generally mounted to swing the toggle away from the stop abutment and passed the zero feed point and into the reverse feed condition of the toggle. When this occurs in the prior art the vibrations are no longer absorbed by the frame and large unbalanced vibratory forces and noise occur.

SUMMARY OF THE INVENTION

The present invention overcomes these problems of the prior art by providing a stitch regulator in which not only are the dynamic loads during forward feed transmitted to the stop abutment and absorbed by the frame, but also provides an operator accessible knob and a gearing system for adjusting the stitch length regulator without the necessity for tipping the machine. The invention further provides a dynamic damper to counterbalance the regulating toggle so that during reverse feed when the toggle is disengaged from the stop abutment, the vibrations and noise of the system are substantially reduced.

It is therefore a primary object of the present invention to provide a stitch length regulator for high speed sewing machines in which vibration forces are substantially balanced during forward and reverse feed and which includes an accessible control operator for changing the forward stitch length.

Another object of this invention is to provide a stitch length regulator for high speed sewing machines in which the feed stop abutment for determining the forward stitch length transmits the feed system reaction forces directly to the frame of the sewing machine and in which dynamic damping means are provided for balancing the forces when the stop abutment is disengaged from the regulator control member during reverse stitching.

BRIEF DESCRIPTION OF THE DRAWINGS

Other objects and advantages of this invention will best be understood upon reading the following detailed description of the invention with the accompanying drawings, in which:

FIG. 1 is a front elevational view of a sewing machine incorporating the improved stitch length regulating system constructed in accordance with the present invention;

FIG. 2 is an enlarged sectional view taken substantially along line 2—2 of FIG. 1;

DESCRIPTION OF THE PREFERRED EMBODIMENT

Figure 3:
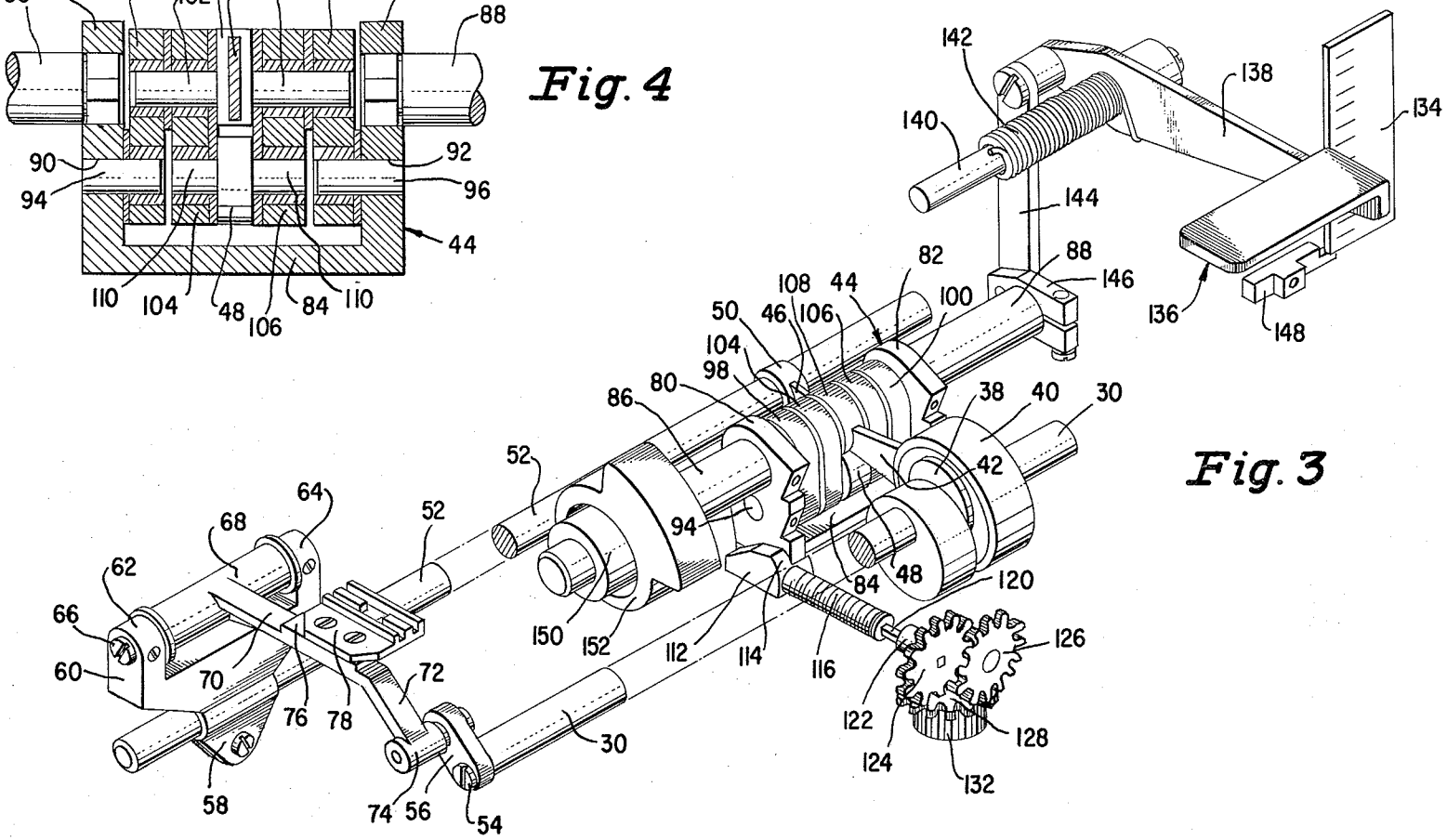
FIG. 3 is a perspective view of the stitch length regulating system of the present invention removed from the sewing machine for purposes of clarity.
Figure 4:
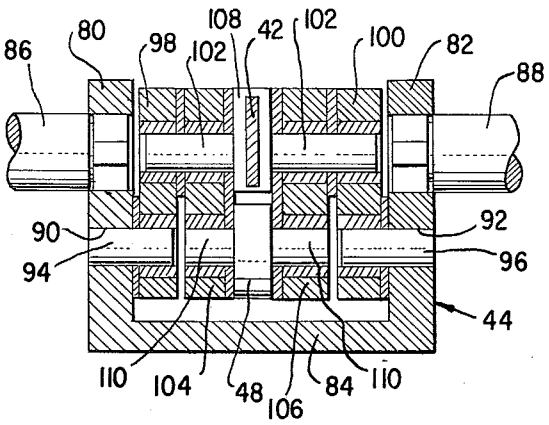
FIG. 4 is a fragmentary cross sectional view through the yoke of the stitch length regulating toggle mechanism of the regulating system.

Referring now to the accompanying drawings FIG. 1 illustrates an industrial type sewing machine 10 incorporating the preferred form of the improved stitch regulating mechanism of the present invention. Conventionally, the sewing machine is supported on a work table 12 and includes a needle 14 mounted in a needle bar 16 adapted to be driven at least in endwise reciprocation in a sewing head 18 overlying the work support portion of the bed 20. Any conventional means may be used for driving the needle bar 16. In the preferred embodiment a motor drive 22 mounted beneath the bed includes a toothed belt pulley 24 about which is trained a timing belt 26 also trained about another pulley 28 on a bed shaft 30 journalled in the sewing machine. Another belt 32 trained about a pulley 34 on the bed shaft is operative to drive an arm shaft (not illustrated) mounted in the sewing machine arm 36 operatively connected to drive the needle bar.

Mounted on the bed shaft 30 for rotation therewith is a feed advance eccentric 38 which carries and drives an eccentric strap 40 to provide oscillating motion to one end of an integral pitman arm 42 whose other end supplies rocking motion to a toggle type feed regulating member generally indicated at 44. The rocking motion transmitted to the regulating member 44 is adjustably controlled as hereinafter described and transferred to one end 48 of an output rocker arm 46 having its other end 50 secured to a feed advance rocker shaft 52 journalled in the frame of the sewing machine. Also mounted on the rotary bed shaft 30 is a feed lift shaft eccentric 54 which imparts oscillatory rocking motion to an arm 56 which supplies the proper rocking motion for the feed lift.

Secured to the feed advance rocker shaft 52 by conventional means which preferably is illustrated as a bifucated clamp 58 is a rocker arm in the form of a yoke member 60 having a pair of spaced arms 62 and 64. A small stud shaft 66 spans and is secured to arms 62 and 64 for journally supporting a cylindrical hub portion 68 formed on one end of a feed bar 70. The feed bar extends transversely across the sewing machine and is angularly disposed downwardly at 72 and terminates at a hub 74 which is pivotably journalled on the arm 56 at a location vertically spaced above the eccentric 54. Mounted on a raised section 76 at substantially the center of the bar 70 is a conventional feed dog 78 which acts directly on the work to be sewn and in conjunction with a presser bar (not shown) conventionally feeds the work due to the compound motions supplied to the feed bar. It should thus be clear that the rocking motion of the feed advance shaft 52 rocks the yoke 60 and thereby the feed bar while the oscillations of the arm 56 effects cyclical lifting and dropping of the feed bar as it pivots about the stud shaft 66. Adjustable control of the rocking motion of the feed advance shaft 52 is provided by the toggle type regulating member 44 which includes a yoke of carrier frame comprising two spaced end members 80 and 82 interconnected by a spanning member 84. A respective stud shaft 86 and 88 is secured to the members 80 and 82 and each shaft is journalled to turn in the frame of the sewing machine. Each end member 80 and 82 further includes a respective aperture 90 and 92 within which is journalled one end. of a respective pin 94 and 96 whose other end is fixed in a respective link 98 and 100. Another pin 102 is journalled in the other end of each link 98 and 100 and journally passes through one end of a second pair of links 104 and 106 on each side of a hub portion 108 of the pitman arm 42 through which the pin also passes and is secured. Another pin 110 is secured to the hub 48 of the rocker arm 46 and passes through and is journalled in the other end of the links 104 and 106. The links 104 and 106 are similar to the links 98 and 100 and the center line of pin 110 is spaced from the center line of the pin 102 by the same distance as the pin 102 is spaced from the center line of the pins 94 and 96. Thus, from the kinematics of the member 44 it is evident that the oscillating motion of the pitman 42 is transformed into a rocking motion at the arm 46 when the center line of pin 110 is not coaxial with the center lines of the pins 94 and 96, and that the further the center line of the pin 110 is from the center lines of the pins 94 and 96 the greater will be the rocking motion imparted to the arm 46 and consequently the greater will be the feed advance and return movement of the feed dog 78. Whenever the yoke member is pivoted about the axis of the shafts 86 and 88, the center line of pins 94 and 96 changes relative to the pin 110.

The means for changing the spacing between the center lines of the pin 110 and the pins 96 and 98 to effect variation in stitch length will now be described. Secured to the yoke spaced from the axis of the shafts 86 and 88 and preferably at the junction of the end member 80 and the spanning 84 is an abutment cam block 112 having a cam surface 114 shaped so that points along the surface are spaced at varying distances from the axis of shaft 86. In the preferred embodiment, as illustrated the cam surface is transversely spaced from the shaft 86 in the front to back direction of the sewing machine. A stop abutment in the form of a threaded member 116 is threadedly mounted in a substantially cylindrical sleeve 118 formed as part of the sewing machine bed casting and extending internally. The member 116 includes a non-threaded portion 120 supported in a sleeve 122 mounted in the bed 20 for rotational movement therewith and for axial movement relative thereto. Thus, rotation of the sleeve causes the member 116 to turn and move axially against the cam surface 114 to force the block 112 and thereby the yoke to turn with the shafts 86 and 88.

In order to turn the sleeve 122, the present invention provides a gear train preferably comprising a first gear 124 secured to the sleeve 122, in mesh with a second gear 126 having an axis of rotation parallel to but spaced from the gear 124 and a third gear 128 which meshes with the gear 126. The gear 128 is mounted on the front under-surface of the oil pan 130 at the bottom of the bed 20 and is secured to an adjusting knob 132. The gears are spur gears preferably having ciruclar arc teeth so that the gear 128 can be 90° to but yet drive the gear 126 without the need for using thicker bevel gears. Thus, in order to change stitch length the operator merely reaches beneath the front of the work table 12 and turns the knob 132 — there is no need to tip the machine. The stitch length may be read on a panel 134 on the sewing machine standard having indicia thereon with the aid of a reversing lever 136 now to be described.

The reversing lever 136 includes an arm 138 pivotaby journalled intermediate its extremities on a stud shaft 140. The shaft 140 is fixed in the frame of the sewing machine and includes a tension spring 142 secured thereto and having an end abutting against the arm 138 to bias the arm upwardly into the forward stitch direction. The arm 138 is further pivotably connected at a location on the opposite side of the shaft 140 from the lever 136 to a lever 144. The lever 144 in turn is pivotably connected to a small link 146 secured to the stud shaft 88 at a location spaced from the axis of shaft 88. Thus, any turning of the shaft 88 due to adjustment of the knob 132 causes lever 136 to move and indicate the relative stitch length on the panel 134. Moreover, depression of the lever 144 causes the yoke to move off the stop abutment and swing past zero feed into reverse stitch. An adjustable slidable stop member 148 sets the stitch length in reverse feed by limiting the movement of the lever 136.

Since the threaded member 116 is threaded directly into the sewing machine frame its reaction forces due to dynamic loads generated in the toggle regulating system 44 are transmitted directly to the frame during forward feed since the cam surface 114 is against the member 116. This short, stiff and direct path from dynamic force generation to positive stop provides good vibration and noise damping and minimizes vibration in the reversing lever 136. However, when reverse feed is desired the cam surface 114 is removed from the abutment 116 and normally excessive vibration would be encountered. However, the present invention provides a dynamic damper 150 on the stud shaft 86 to reduce vibration and noise of the reversing system. The dynamic damper consists of an elastomeric member mounted on a hub 152 secured to the shaft 86. This mass acts as a torsion spring to counter the torsional vibration acting on the yoke 80, 84, 86 to reduce the angular amplitudeof the vibration in the system including the lever 136.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims.

Having thus set forth the nature of the invention, what we heretofore claim is:

1. A work feed mechanism for a sewing machine having a drive shaft rotatably mounted in the bed of the machine, a feed dog adapted to engage and feed the work, means including a rock shaft for oscillating said feed dog along the line of work feed, means connecting the drive shaft to the feed dog for oscillating said feed dog normal to the line of work feed, an eccentric on said drive shaft, a stitch length controlling device including a carrier frame, means for pivotably mounting said frame in the bed, said frame carrying linkage connecting said eccentric and said rock shaft for oscillating said rock shaft upon rotation of said drive shaft and for varying the oscillation of the rock shaft upon pivotable movement of said carrier frame, forward stitch adjusting means including an abutment cam member secured to said carrier frame and an abutment stop member threadedly received in the bed of the sewing machine and disposed to abut said cam member to pivotably move said carrier frame upon axial movement of said stop member, a gear train including a first gear, means for securing said stop member for rotation with and axially movable relative to said first gear, a second gear in driving engagement with said first gear, and an operator influenced member secured to said second gear and rotatably mounted on the bed, whereby rotation of the operator influenced member effects axial movement of the stop member to turn said carrier frame and thereby change the stitch length.

2. A work feed mechanism as recited in claim 1 wherein said means for mounting said carrier frame comprises shaft means secured to said carrier frame, reverse feeding means comprising an operator influenced lever, means for pivotably mounting said lever in the sewing machine, and means for operatively connecting the lever to turn said shaft means in a direction to separate said cam member from said stop member, and a dynamic damper mounted on said shaft means to counter-balance the dynamic forces when the cam member and the stop member are separated.

* * * * *